United States Patent [19]

Fagan

[11] Patent Number: 4,955,150

[45] Date of Patent: Sep. 11, 1990

[54] IDENTIFICATION SYSTEM FOR FOOTWEAR

[76] Inventor: Nancy L. Fagan, Joy Ave., Stonington, Conn. 06378

[21] Appl. No.: 395,781

[22] Filed: Aug. 18, 1989

[51] Int. Cl.[5] ..... A43B 23/24; A44C 3/00

[52] U.S. Cl. ..... 36/136; 40/636

[58] Field of Search ..... 36/136, 54; 40/633, 40/636, 662, 665, 640, 159, 644, 642, 657, 653, 660, 661, 666

[56] References Cited

U.S. PATENT DOCUMENTS

| | | | |
|---|---|---|---|
| D. 283,556 | 4/1986 | Campbell | 36/136 |
| 348,233 | 8/1886 | Phalan | 36/136 |
| 1,502,919 | 7/1924 | Seib | 36/136 |
| 1,539,744 | 5/1925 | Kelly | 40/665 |
| 1,952,409 | 3/1934 | Berg | 36/136 |
| 2,616,189 | 11/1952 | Smith | 36/136 |
| 2,712,700 | 7/1955 | Solomon | 36/136 |
| 2,801,477 | 8/1957 | Adams et al. | 40/636 |
| 2,871,537 | 2/1959 | Hickerson | 24/117 |
| 2,925,675 | 2/1960 | Lumpkin | 40/159 |
| 3,078,897 | 2/1963 | Rifkin | 40/666 |
| 3,466,774 | 9/1969 | Borresen | 40/642 |
| 4,254,566 | 3/1981 | Haskell | 40/2 E |
| 4,305,216 | 12/1981 | Skelton | 40/159 |
| 4,327,512 | 5/1982 | Oliver | 40/2 E |
| 4,372,060 | 2/1983 | Adamik | 36/54 |
| 4,507,882 | 4/1985 | Harrell | 36/136 |
| 4,536,975 | 8/1985 | Harrell | 36/136 |
| 4,676,570 | 1/1987 | Pincherri | 439/148 |
| 4,852,276 | 8/1989 | Savoca et al. | 40/636 |
| 4,897,947 | 2/1990 | Kass-Pious | 40/636 |

FOREIGN PATENT DOCUMENTS

| | | | |
|---|---|---|---|
| 3337319 | 5/1984 | Fed. Rep. of Germany | 36/136 |
| 2067385 | 7/1981 | United Kingdom | 36/136 |

*Primary Examiner*—Steven N. Meyers

*Attorney, Agent, or Firm*—Albert W. Hilburger

[57] ABSTRACT

An identification system for mounting on the outer surface of the tongue of footwear and beneath the laces, flap, or other device used for fastening the footwear to the wearer. It is intended primarily for young children or incompetent adults and comprises a tubular member of pliable, liquid impermeable material defining an internal compartment with a closure mechanism to isolate the internal compartment from ambient conditions and substantially prevent entry of water and other substances. Vital information concerning the wearer may be placed in the compartment and is accessible when necessary but is not visible to the casual observer. Provision is made for temporary mounting and for permanent mounting of the tubular member to the tongue of the footwear.

11 Claims, 3 Drawing Sheets

IDENTIFICATION SYSTEM FOR FOOTWEAR

BACKGROUND OF THE INVENTION

I. Field of the Invention

The present invention relates to an identification system which can be readily applied to the tongue of footwear but which does not call attention of its presence or of the identification of the wearer to the casual observer.

A substantial need exists to provide toddlers with a ready means of identification in the event they inadvertantly wander from their parents or other companions. This can happen to even the most attentive of people in crowded situations such as often occur at shopping malls and the like. At the same time, it is not desireable to provide vital information regarding the child in some prominent manner such that it could prove advantageous to depraved people such as kidnappers, sexual abusers, and the like.

Another class of beneficiaries might be mentally impaired children or adults who might easily become disoriented if separated from a companion. Then, too, persons such as diabetics or epileptics who are subject to seizures and rendered non communicative during such an event, would benefit from such a system which would desireably provide not only identification, but information regarding the impairment and appropriate methods for treatment.

Runners or joggers would also benefit from the invention. The practice of running or jogging as a means of improving or maintaining physical fitness has become common place in our present society. Much of the running and jogging is performed along traveled thoroughfares and many times in areas where the runner or jogger is unknown. The danger of an accident occurring is always present and frequently, neither the identity of, nor pertinent medical facts concerning, the runner or jogger are available.

II. Description of the Prior Art

The concept of providing footwear with identification devices or compartments for holding valuables belonging to the wearer is admittedly old. In some early instances, as presented in the U.S. Pat. Nos. 348,233 to Phalan, and 1,502,919, to Seib, compartments were provided on the inside, upper regions of a boot or high shoe.

In a variety of other, more recent, constructions, devices with compartments or other provision for placement of important indicia have been utilized, being attached, in one manner or another, by means of the laces which the fasten the footwear to the wearer. Examples of such known constructions are presented in the U.S. Pat. Nos. 2,712,700, to Solomon, 2,871,537, to Hickerson, 4,254,566, to Haskell, 4,327,512, to Oliver, and 4,507,882 and 4,536,975 to Harrell.

In yet another instance, the tongue itself of a shoe is hollow to receive such items as coins, identification card, keys, and the like. Such a disclosure is presented in the U.S. Pat. No. 4,372,060 to Adamik.

Still another construction is disclosed by Smith in U.S. Pat. No. 2,616,189 which provides a footwear identification plate attached to the underside of a hunting boot by means of an ankle embracing harness. An identification tag passes beneath the shoe arch between heel and sole and is suspended from the harness by a plurality of wires. Of course, while the device of Smith may be satisfactory for purpose of a heavy hunting boot, it is totally unacceptable for lighter footwear, whether casual or for dress purposes.

All of the known devices have drawbacks which have dissuaded the public from their use. For example, the shoe disclosed in Solomon '700, mentioned above, calls for a specialized design to specifically accommodate the device on its vamp. Other previously mentioned constructions such as those disclosed by Hickerson '537, Haskell '566, Oliver '512, and Harrell '882 and '975, are applicable only to footwear utilizing laces. In many of these instances, the devices are provided with holes adapted to receive the laces. Indeed, in many of these instances, the device could inadvertantly separate from the footwear should the laces ever become untied.

There is no known instance of an indicia carrying device provided with a closure having a fluid tight seal as a protection for the contents of the compartment within the device.

It was in recognition of the drawbacks of the known devices and systems that the present invention was conceived and has now been reduced to practice.

SUMMARY OF THE INVENTION

To this end, the present invention relates to an identification system for mounting on the outer surface of the tongue of footwear and beneath the laces, flap, or other device used for fastening the footwear to the wearer. It is intended primarily for young children or incompetent adults and comprises a tubular member of pliable, liquid impermeable material defining an internal compartment with a closure mechanism to isolate the internal compartment from ambient conditions and substantially prevent entry of water and other substances. Vital information concerning the wearer may be placed in the compartment and is accessible when necessary but is not visible to the casual observer. Provision is made for temporary mounting and for permanent mounting of the tubular member to the tongue of the footwear.

One object of the invention is to provide such an identification system which is lightweight, inexpensive, comfortable, of simplified construction, and one which can be used with all forms of footwear having a tongue.

A primary object of the invention is to provide such an identification system which is water tight so as to protect the contents of the internal compartment.

Another object of the invention is to provide such an identification system in various colors and textures to match the color and texture of the footwear with which it is to be used.

Still another object of the invention is to provide an identification system which is convenient, yet not visible to someone who might cause harm to the wearer; also, one which is not easily accessible to the wearer in the event the wearer is a toddler or incompetent person.

Yet another object of the invention is to provide such an identification system which can be applied to footwear immediately upon its purchase and, thereafter, can be more permanently attached to the footwear to enable it to withstand rough usage.

Although a primary purpose of the invention is identification of the wearer or medical conditions to which the wearer may be subject, it is not intended that is use be so limited. That is, the invention may also be used to hold a variety of other items such as coins, keys, small jewelry items, and the like, as necessary or desirable.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of the invention, illustrate one of the embodiments of the invention and, together with the description, serve to explain the principles of the invention in general terms. Like numerals refer to like parts throughout the disclosure.

DETAILED DESCRIPTION OF THE PREFERRED EMBODIMENTS

Figure 1:
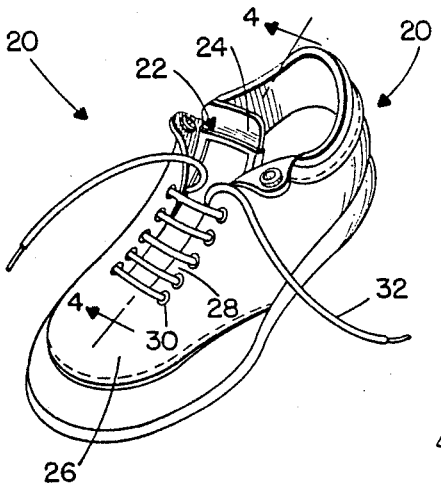
FIG. 1 is a perspective view of laced footwear utilizing the identification system of the invention.

Turn now to the drawings and initially to FIG. 1 which illustrates footwear 20 which utilizes an identification system 22 embodying the invention. The footwear 20 may be of any desired style so long as it incorporates a tongue 24 in its design. That is, it may be for casual wear such as a moccasin, it may be for sport wear such as a running shoe, or it may be for dress wear such as, for example, an oxford.

Figure 2:
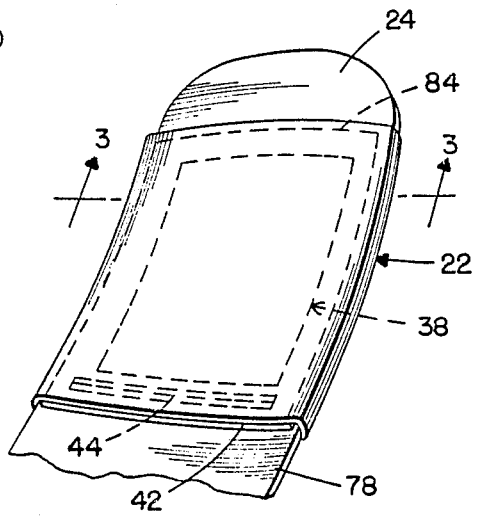
FIG. 2 is a detailed perspective view of the tongue of the footwear illustrated in FIG. 1 to which one embodiment of the identification system of the invention has been attached.
Figure 3:
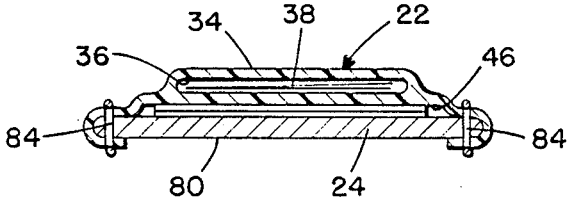
FIG. 3 is a cross section view taken generally along line 3—3 in FIG. 2.
Figure 4:
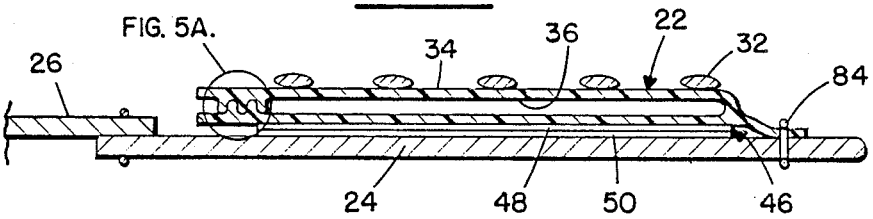
FIG. 4 is a cross section view taken generally along line 4—4 in FIG. 1.

In each instance, the identification system 22 is mounted on an upper surface of the tongue 24 as more clearly seen in FIGS. 2, 3, and 4. In most conventional footwear, the tongue 24 is sewn or otherwise attached to the vamp 26 and extends aft and across the region between opposed flaps 28 containing a plurality of longitudinally spaced eyelets 30. Shoelaces 32 of suitable elongate material extend through the eyelets 30 and follow an appropriate crisscrossed pattern. The eyelets 30 and shoelaces 32 together provide a fastening mechanism when the free ends of the shoelaces are drawn tight, then tied, to prevent unintended removal of the footwear from the wearer.

Figure 5:
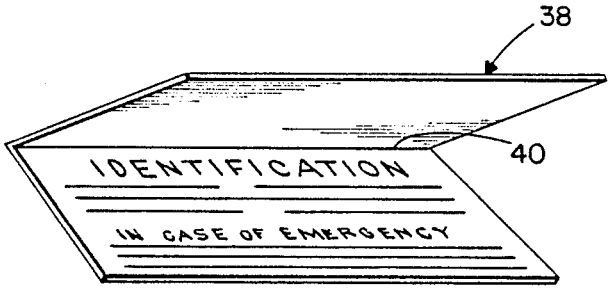
FIG. 5 is a perspective view of the indicia component of the invention.

As best seen in FIGS. 3 and 4, the identification system 22 includes an elongated tubular member 34 composed of pliable, liquid impermeable, material defining an internal compartment 36 capable of receiving and holding items of importance to the wearer of the footwear 20. Such an item may be an indicia card 38 (FIG. 5) sized to fit within the internal compartment 36 and possibly folded about a fold line 40 for purposes of privacy and improved stiffness to increase the ability of its insertion into the compartment. The indicia card 38 may be completed with appropriate information concerning the wearer, specifically, for example, name, address, telephone number, mention of known diseases or unusual conditions, and the like.

The tubular member 34 may be composed of a lightweight plastic material such as polyvinyl or other suitable material which is pliable and waterproof, but rugged. In this manner, it is able to withstand repeated abrasion as it is positioned between the tongue 24 and the laces 32 of the footwear 20 and thereby repeatedly subjected to the flexing motions of the footwear. The tubular member 34 may be transparent, but would preferably be of a color similar to that of the footwear upon which it is to be mounted. It would also be desirable for the outer surface of the tubular member to be textured in a manner similar to that of the footwear 20.

Figure 5A:
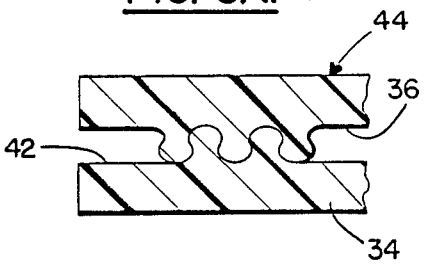
FIG. 5A is an enlarged, detail, cross section view of the closure mechanism of the invention illustrated in FIGS. 4 and 8.

Access to the internal compartment 36 is achieved at an entry 42 provided at one end of the tubular member (see FIGS. 2 and 5A). Adjacent the entry 42 is a closure mechanism 44 for selectively sealing the tubular member. The closure mechanism 44 may be of the construction manufactured and sold under the trademark "ZIPLOCK" by the Dow Chemical Company of Midland, Mich. This construction is most clearly seen in FIGS. 4 and 5A and serves to isolate the internal compartment 36 from ambient conditions and substantially prevent entry therein of water and other substances. The concept is that once the indicia card 38 is inserted into the compartment 36 and the closure mechanism 44 selectively sealed, no matter what the weather conditions or the environment to which the footwear 20 is subjected, the indicia card 38 will remain dry and unsoiled to enable its readability at a future time.

A noteworthy feature of the invention resides in its construction which provides for attachment of the tubular member 34 to the tongue 24. In one instance, the tubular member 34 may be releasably attached to the tongue 24 and in another instance it may be fixedly attached to the tongue. In the former instance, as seen in FIGS. 3 and 4, a suitable mounting mechanism 46 is depicted which includes hook and loop fastening material such as that manufactured and sold under the trademark "VELCRO" by The Velcro Corporation of America of New York, N.Y. In this instance, a first element 48 of the hook and loop material is mounted on the tubular member 34 and a second element 50 of the hook and loop material is mounted on the tongue 24. In this manner, upon mutual mating engagement of the first and second elements 48, 50, the tubular member becomes removably attached to the tongue of the footwear.

Figure 6:
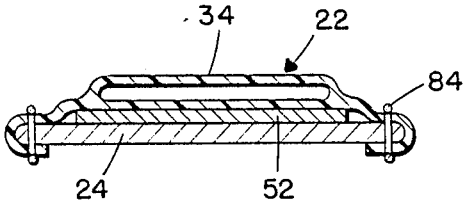
FIG. 6 is a cross section view similar to FIG. 3 illustrating another embodiment of the invention.

Another instance of a mounting mechanism for releasably attaching the tubular member 34 to the tongue 24 is illustrated in FIG. 6. In this instance, a mounting mechanism 52 is provided in the form of pressure sensitive adhesive on the tubular member such that upon mutual mating engagement of the tubular member 34 with the tongue 24, the tubular member becomes removably attached to the tongue of the footwear.

Figure 7:
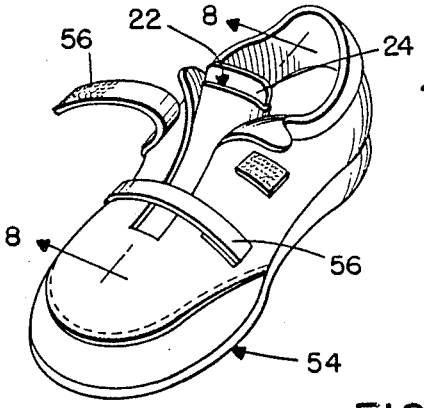
FIG. 7 is a perspective view, similar to FIG. 1, illustrating yet another embodiment of the invention.
Figure 9:
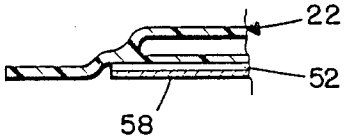
FIG. 9 is a detail cross section view similar to parts shown in FIG. 6 but illustrating a further embodiment of the invention.
Figure 8:
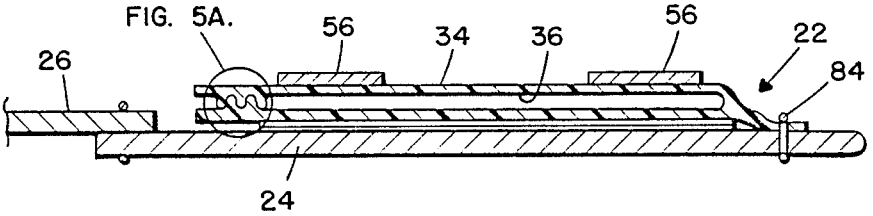
FIG. 8 is a cross section view taken generally along line 8—8 in FIG. 7.

In either instance, the tubular member 34 thereby becomes intimately positioned intermediate the tongue 24 and the laces 32 in those instances in which the footwear 20 is of a laced design. In recent years, however, footwear 54 have become popular which utilize straps 56 attached by means of VELCRO fasteners to prevent removal of the footwear from the foot of the wearer. .This construction is illustrated in FIGS. 7 and 8. Again, however, it is seen that the identification system 22 is firmly maintained between the straps 56 and the tongue 24 when the footwear 54 is in a condition ready for use. In the instance in which the mounting mechanism 52 (FIG. 6) is employed, it is desirable to provide a removable backing sheet 58 of protective material initially mounted on and overlying the pressure sensitive adhesive (FIG. 9). When it is intended to actually affix the identification system 22 to the tongue 24, the backing sheet 58 is removed in a known manner to expose the pressure sensitive adhesive.

Figure 10:
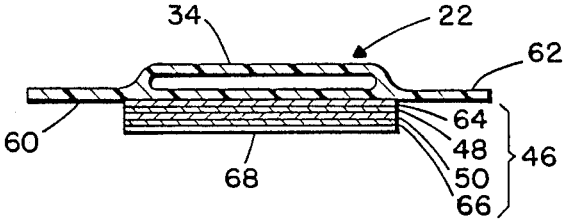
FIG. 10 is a cross section view illustrating in greater detail components depicted in FIG. 3.

A more detailed description of the tubular member 22 illustrated in FIG. 3 can be related with reference to FIG. 10 in which the tubular member depicted has an undersurface 60 for placement on the tongue 24 and an oversurface 62 oppositely disposed. For purposes of this more detailed explanation, the mounting mechanism 46 is seen to include a first element 48 of the hook and loop material being a first layer and a second layer composed of the second element 50 of the hook and loop material matingly engaged with the first element 48. A third layer 64 of pressure sensitive adhesive serves to mount the first element 48 to the under surface 60 of the tubular member 22. A fourth layer 66 also composed of pressure sensitive adhesive is applied to the second element 50 of hook and loop material opposite the first element 48 and a selectively removable protective backing sheet 68 initially overlies and adheres to the fourth layer 66 which is the pressure sensitive adhesive.

It is in this condition that the tubular member 34 would be made commercially available to the public. Thus, for initial use, the backing sheet 68 would be stripped from the fourth layer 66 thereby exposing the fourth layer. Thereupon, the tubular member 34 would be pressed into position against the tongue 24, preferably with the entry 42 proximate to the vamp 36. With the fourth layer 66 properly adhering to the tongue 24, it is possible to peel the first element 48 from the second element 50 and thereby selectively remove the tubular member 34 from the tongue 24. By reversing the process, of course, the tubular member 34 can again be attached to the tongue 24.

Figure 11:
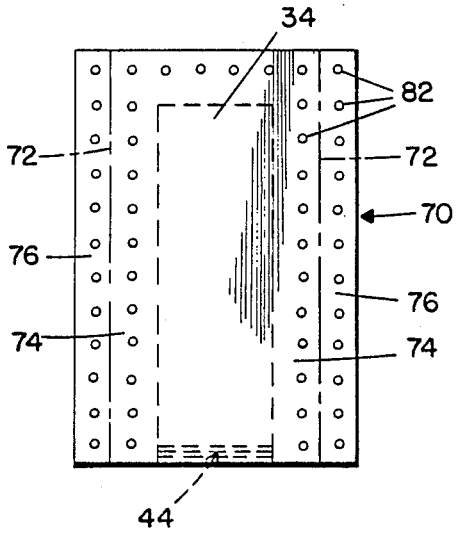
FIG. 11 is a top plan view of components depicted in FIGS. 2, 3, and 4.

While the mounting mechanism 46 is generally satisfactory for normal usage, a more rugged mechanism may be desirable if the footwear 20 is to be subjected to harsh usage of the type for which toddlers are noted. To this end, viewing FIG. 11, a secondary mounting mechanism may be provided which includes a peripheral flange 70 integral with the tubular member 34 and extending outwardly therefrom. As seen in FIG. 11, the peripheral flange 70 is elongated and has a longitudinally extending score line 72 to either side of, and spaced from, the tubular member 34 thereby forming first and second mounting components 74, 76, respectively, in side by side relationship. The first mounting component 74 is positioned proximate the tubular member 34 while the second mounting component 76 is distant from the tubular member.

The unit depicted in FIG. 11 may utilize the temporary mounting mechanism 46 as illustrated in FIG. 10 or the alternate mounting mechanism 52 depicted in FIG. 6, or any other suitable temporary mounting mechanism. In any event, the tubular member 34 is mounted to the tongue 24 in the manner previously described but with the added requirement that the score lines 72 are positioned to assume a contiguous relationship with their mating respective peripheral edges 78 (FIG. 2) of the tongue 24. With the unit illustrated in FIG. 11 so positioned on the tongue 24, each of the mounting components 76 are folded along its associated score line 72 into contiguous relationship with a lower surface 80 of the tongue 24. The peripheral flange 70 may be provided with a plurality of spaced holes 82 to receive elongate material 84 (See FIGS. 2 and 3) such as thread or the like enabling the unit to be stitched to the tongue 24.

Figure 12:
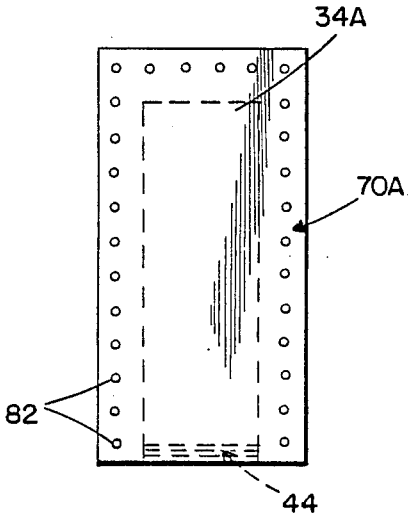
FIG. 12 is a top plan view of an embodiment somewhat modified from that illustrated in FIG. 11.
Figure 13:
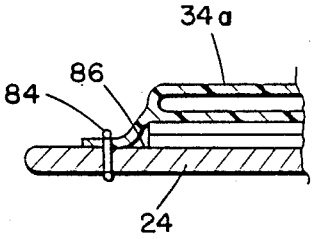
FIG. 13 is a detail cross section view generally similar to FIG. 3 but utilizing parts illustrated in the embodiment of FIG. 12.

The construction illustrated in FIGS. 2, 3, 6, and 11 using the mounting components 74, 76, is preferred because of the sturdy attachment thereby achieved. However, the construction as depicted in FIGS. 12 and 13 according to which a modified peripheral flange 70A is integral with a tubular member 34A and has a single mounting component for attachment only to an upper surface 86 of the tongue 24 (FIG. 13) is also within the scope of the invention.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. The combination comprising:

footwear of the type having a tongue and means selectively overlying said tongue for releasably fastening said footwear to the wearer;

an identification system for placement on said footwear including:

elongated tubular member of pliable, liquid impermeable material defining an internal compartment capable of receiving and holding items of importance to the wearer of said footwear;

entry means at one end of said tubular member for providing access to the internal compartment;

closure means for selectively sealing said entry means to isolate the internal compartment from ambient conditions and substantially prevent entry therein of water and other substances; and primary pressure sensitive mounting means for releasably attaching said tubular member to said tongue;

said tubular member being intimately positioned intermediate said tongue and said fastening means of said footwear thereby preventing unintended removal thereof when said footwear is in its operative condition.

2. The combination as set forth in claim 1 including:

secondary mounting means independent of said primary mounting means for fixedly attaching said tubular member to said tongue.

3. An identification system as set forth in claim 2 wherein said secondary mounting means includes a peripheral flange integral with said tubular member for mounting said tubular member on said tongue.

4. An identification system as set forth in claim 3 wherein said peripheral flange has a plurality of spaced holes therein for receiving elongate material for permanent attachment of said tubular member to said tongue.

5. An identification system as set forth in claim 3 wherein said peripheral flange is elongated and has a longitudinally extending score line therein forming first and second mounting components in side by side relationship, said first mounting component being proximate said tubular member, said second mounting component being distant from said tubular member;

whereby, to mount said tubular member on said tongue, said first mounting component is moved into contiguous relationship with one surface of said tongue, said score line into contiguous relationship with a peripheral edge of said tongue, and said second mounting component folded along said score line into contiguous relationship with an opposite surface of said tongue.

6. An identification system as set forth in claim 5 wherein said first mounting component and said second mounting component each has a plurality of spaced holes therein for receiving elongate material for permanent attachment of said tubular member to said tongue.

7. An identification system as set forth in claim 1 wherein said primary pressure sensitive mounting means includes:

a layer of pressure sensitive adhesive on said tubular member; and a removable backing sheet of protective material initially mounted on and overlying said pressure sensitive adhesive;

such that upon removal of said backing sheet and mutual mating engagement of said tubular member with said tongue, said tubular member becomes removably attached to said tongue.

8. An identification system as set forth in claim 1 wherein said tubular member includes first and second coextensive sheet members in contiguous relationship; and wherein said closure means includes first and second frictionally matingly releasably engageable seal elements on said first and second sheet members, respectively, adjacent said entry means; whereby mutual engagement of said first and second seal elements operates to isolate the internal compartment from ambient conditions and substantially prevent entry therein of water and other substances.

9. An identification system as set forth in claim 1 wherein said tubular member has an undersurface for placement on said tongue and an oversurface oppositely disposed; and wherein said primary mounting means includes: a first layer composed of a first element of hook and loop fastening material;

a second layer composed of a second element of hook and loop material matingly engaged with said first element of hook and loop fastening material;

a third layer composed of pressure sensitive adhesive for mounting said first layer to said undersurface of said tubular means;

a fourth layer composed of pressure sensitive adhesive applied to said second element of hook and loop material opposite said first element of hook and loop fastening material; and a selectively removable protective backing sheet overlying and in adhering relationship with said fourth layer;

whereby, upon removal of said backing sheet from said fourth layer and movement of the unitary structure comprised of said tubular member and said first, second, third, and fourth layers against an outer surface of said tongue, said second element of the hook and loop material is caused to adhere to said tongue by means of said fourth layer, said tubular member being selectively removable from said tongue upon mutual disengagement of said first and second elements of the hook and loop fastening material.

10. The combination as set forth in claim 1; wherein said primary pressure sensitive mounting means includes hook and loop fastening material having a first element thereof mounted on said tubular member and a second element thereof adapted to be mounted on said tongue such that upon mutual mating engagement of said first and second elements, said tubular member becomes removably attached to said tongue.

11. The combination as set forth in claim 1; wherein said primary pressure sensitive mounting means includes pressure sensitive adhesive on said tubular member such that upon mutual mating engagement of said tubular member with said tongue, said tubular member becomes removably attached to said tongue.

* * * * *